US005125338A

United States Patent [19]

Henson

[11] Patent Number: 5,125,338

[45] Date of Patent: Jun. 30, 1992

[54] ARTICLE FEEDING APPARATUS WITH ELECTRO-RHEOLOGICAL FLUID-TYPE DAMPER

[75] Inventor: Walter H. Henson, Hornchurch, United Kingdom

[73] Assignee: Alcatel Business Systems Limited, United Kingdom

[21] Appl. No.: 626,539

[22] Filed: Dec. 12, 1990

[30] Foreign Application Priority Data

Dec. 30, 1989 [GB] United Kingdom ..... 8929365

[51] Int. Cl.[5] ..... B41F 13/24

[52] U.S. Cl. ..... 101/232; 101/91; 101/53; 192/21.5; 267/140.1 E

[58] Field of Search ..... 101/232, 233, 37, 91, 101/53, 216; 192/21.5; 188/268, 267, 322.5; 267/219, 140.1 E, 140.1 AE, 140.1 C

[56] References Cited

U.S. PATENT DOCUMENTS

| | | | |
|---|---|---|---|
| 3,144,921 | 8/1964 | Martinek | 192/21.5 |
| 4,444,298 | 4/1984 | Stangroom | 192/21.5 |
| 4,645,614 | 2/1987 | Goosens et al. | 267/140.1 E X |
| 4,648,576 | 3/1987 | Matsui | 267/140.1 X |
| 4,705,413 | 11/1987 | Arnoldi | 101/232 |
| 4,765,600 | 8/1988 | Härtel | 267/140.1 E X |
| 4,787,311 | 11/1988 | Mol | 101/232 |
| 4,802,560 | 2/1989 | Bhadra | 188/264 F |
| 4,841,858 | 6/1989 | Bannister | 101/232 |
| 4,858,733 | 8/1989 | Noguchi | 188/267 |
| 4,893,800 | 1/1990 | Tabata | 188/267 X |
| 4,981,286 | 1/1991 | Kato | 267/219 X |
| 5,000,299 | 3/1991 | Goto | 188/267 |
| 5,007,513 | 4/1991 | Carlson | 192/21.5 |
| 5,009,402 | 4/1991 | Sato | 267/219 X |

FOREIGN PATENT DOCUMENTS

| | | | |
|---|---|---|---|
| 77195 | 4/1983 | European Pat. Off. | 267/140.1 AE |
| 1432 | 1/1985 | Japan | 192/21.5 |
| 231028 | 9/1988 | Japan | 188/267 |
| 229129 | 9/1989 | Japan | 188/267 |
| 295041 | 11/1989 | Japan | 188/267 |

*Primary Examiner*—Edgar S. Burr
*Assistant Examiner*—Eric Raciti
*Attorney, Agent, or Firm*—Shoemaker and Mattare, Ltd.

[57] ABSTRACT

An article feeding apparatus comprising a driven roller and a pressure roller resiliently urged toward the driven roller. Movement of the pressure roller toward the driven roller is controlled by means of a damper containing material having electro-rheological properties. An electric potential of controlled magnitude is applied selectively to the material to control movement of the pressure roller. The apparatus is described in relation to a print drum and impression roller of a franking machine.

8 Claims, 2 Drawing Sheets

ARTICLE FEEDING APPARATUS WITH ELECTRO-RHEOLOGICAL FLUID-TYPE DAMPER

BACKGROUND OF THE INVENTION

This invention relates to the feeding of articles and in particular to the feeding of mail items in franking machines.

In known franking machines, printing of the franking impression on a mail item is effected by means of a print drum carrying a printing plate for printing the invariable part of the impression and printing wheels settable to print a desired value of postage charge and the date. Franking of the mail item is effected during a single revolution of the print drum. During this rotation of the print drum, the mail item is pressed into printing engagement with the printing plate and printing wheels by means of an impression roller. To provide the required pressure for effecting printing, the impression roller is urged resiliently toward the print drum. After completion of printing of the franking impression the impression roller is retracted to allow the mail item to be ejected from the franking machine. Retraction of the impression roller is accomplished by a follower on a mounting for the impression roller engaging a cam rotating with the print drum. The cam is shaped such that the impression roller is free to be resiliently urged toward the print drum during the period of rotation of the drum in which the printing plate and printing wheels are in printing engagement with the mail item and is retracted by the cam away from the print drum during at least a part of the remainder of the revolution of the print drum.

Due to the shaping of the cam to allow the impression roller to move toward the print drum prior to the start of printing, the force of engagement of the follower on the cam tends to apply an additional forward driving force to the print drum during the period that the impression roller moves towards the print drum with the result that the drum is subjected to a varying rotational drive force during each revolution thereof.

Franking machines are required to print franking impressions on mail items of various thickness. For example mail items may vary in thickness from the relatively small thickness of labels for attachment to mail packets up to substantially thicker items consisting of envelopes containing a number of sheets of paper. In order to provide adequate printing pressure to the thinnest of mail items, the impression roller must be free to exert pressure when it is separated from the print drum by only the thickness of a label while permitting the leading edge of a relatively thick mail item to enter the nip between the print drum and impression roller.

SUMMARY OF THE INVENTION

According to one aspect of the invention apparatus for feeding articles comprises a feed roller; a pressure roller resiliently urged into an operative position adjacent the feed roller to frictionally engage an article to be fed therebetween; means to rotate one of said rollers; cam means rotatable with one of the rollers and a cam follower engaging said cam to move the pressure roller to an inoperative position spaced away from the feed roller; and damper means operable when the cam permits the pressure roller to move towards the operative position thereof to slow the movement of the pressure roller towards the operative position thereof.

The invention also envisages a franking machine for franking mail items incorporating apparatus as hereinbefore defined.

According to another aspect of the invention apparatus for franking mail items comprises a rotatable print drum carrying printing elements; drive means to rotate said print drum about an axis; an impression roller carried on a support for movement toward and away from said print drum; resilient means to urge said impression roller into an operative position adjacent the print drum to frictionally engage a mail item to be fed between said print drum and said impression roller to effect printing on said mail item; cam means rotatable with said print drum; a cam follower connected to said impression roller support and engaging said cam to move said impression roller to an inoperative position spaced away from said print drum; damper means coupled to said impression roller support; said damper means including a material exhibiting electro-rheological properties; and control means operable to apply selectively an electrical potential of selected magnitude to control movement of said impression roller when the cam rotates to a position permitting the pressure roller to move towards said operative position thereof under the action of said resilient means.

BRIEF DESCRIPTION OF THE DRAWING

An embodiment of the invention will now be described with reference to the drawings in which.

DESCRIPTION OF THE PREFERRED EMBODIMENT

Figure 1:
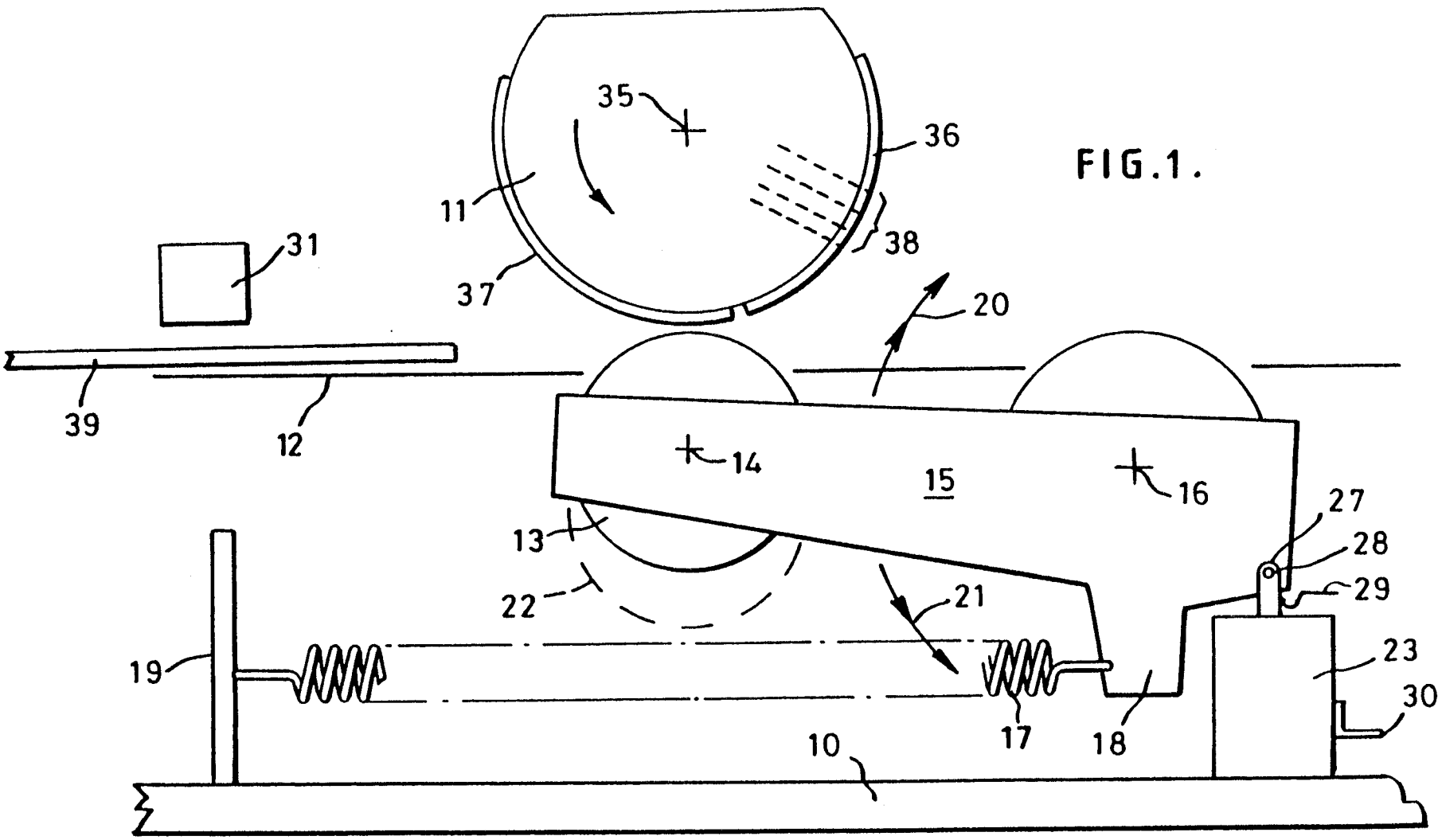
FIG. 1 is a side view of a print drum and an impression roller mounted and controlled in accordance with the invention.
Figure 2:
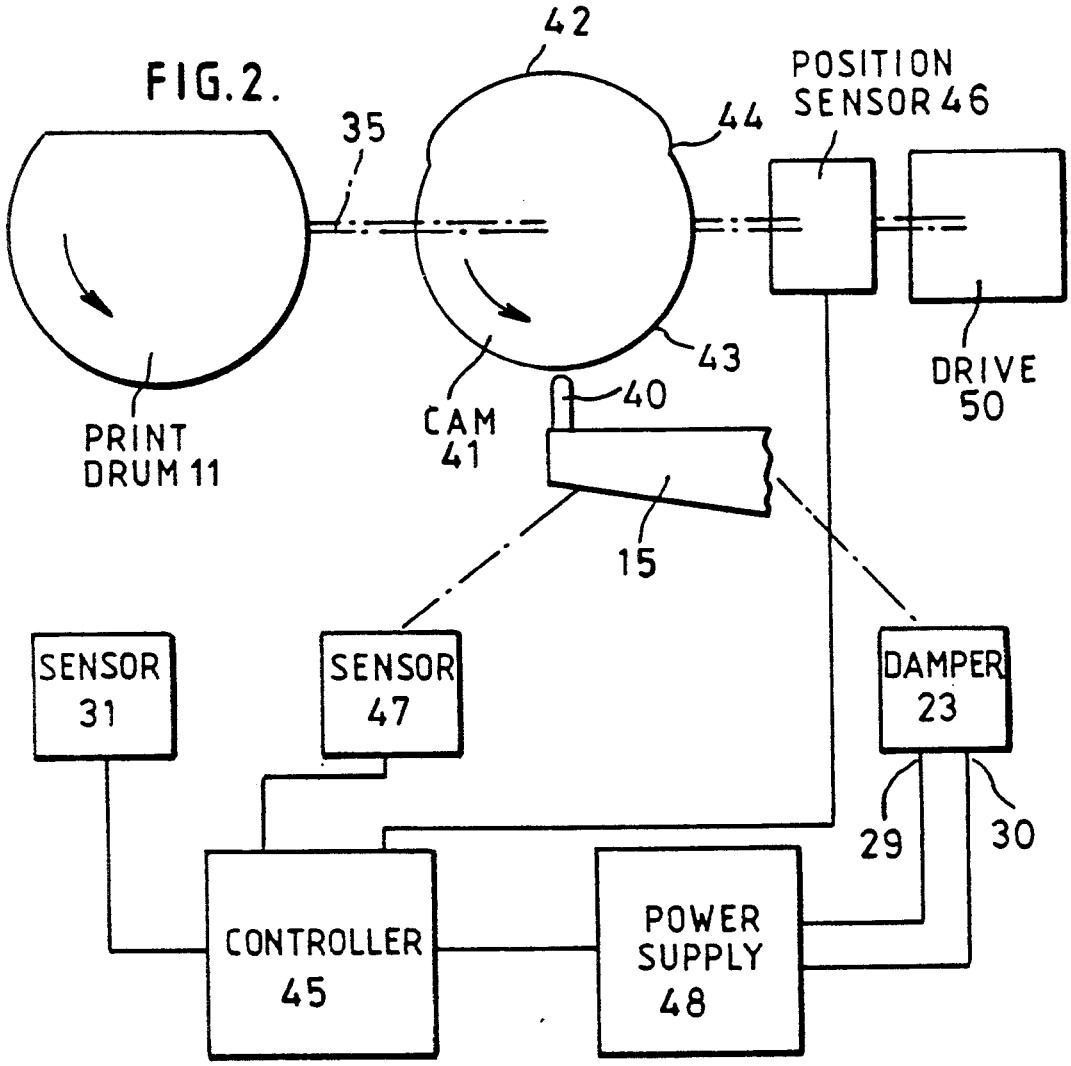
FIG. 2 is a schematic block diagram illustrating a cam and control circuits for controlling movement of the impression roller, and FIGS. 3(*a*) and 3(*b*) are sections through a controlled damper for the impression roller mounting.

Referring first to FIGS. 1 and 2 of the drawings, a base 10 of a franking machine supports a print drum 11 carrying printing elements. The print drum is rotatable about an axis 35 through a single revolution for each franking impression to be printed by drive means 50. The print drum is mounted such that its periphery lies above a feed bed 12 for mail items and is spaced from the feed bed by a distance greater than the largest thickness of mail item to be handled. On the periphery of the print drum 11, there is mounted a printing plate 36 for printing invariable portions of a franking impression. An additional plate 37 may be provided for printing a user's logo or other advertising material. Print wheels, indicated by 38, are mounted in the interior of the print drum, the peripheries of the wheels bearing characters of variable information to be printed in the impression. The wheels extend through apertures in the print drum peripheral wall so that the faces of the characters lie in the cylindrical surface of the printing plate. The wheels are settable so as to print a desired value of postage charge and the date in the franking impression. The construction of the print drum and its components is well known and is not pertinent to the invention. Hence it is considered to be unnecessary to describe the construction thereof in further detail.

In order to maintain a mail item 39, to be fed along the feed bed 12 by means of feed rollers (not shown), in engagement with the printing elements of the print drum, an impression roller 13 is mounted to project through an aperture in the feed bed in opposition to the print drum. The impression roller is supported for free rotation about an axis 14 in a cradle 15 which is pivotable about an axis 16. A spring 17 is connected between an arm 18 of the cradle and a bracket 19 on the base 10 of the machine. The spring 17 exerts a force on the cradle tending to pivot the cradle in the direction of arrow 20 such that the impression roller is urged toward the print drum 11. A cam follower 40 is secured to the cradle 15 and engages a cam 41 which is secured to and rotatable with the print drum. The cam is shaped such that during the period of rotation of the print drum through a single revolution in which the printing elements are in a printing position opposed to the impression roller, the cradle is unrestrained and is free to pivot under the action of the spring 17 in the direction of arrow 20. Thus the impression roller is urged by the action of spring 17 toward the print drum into an operative position in which the impression roller 13 is effective to press any mail item in the nip between the impression roller and print drum into printing engagement with the printing elements carried by the print drum. As the print drum rotates, the printing elements are inked by an ink roller (not shown) and the franking impression is printed on the mail item by the print elements of the drum. Rotation of the drum carries the mail item along the feed bed. The print drum is of 'D' shape section with the print elements 36, 37 disposed adjacent the curved portion of the drum. Between printing operations the drum is orientated such that the flat portion of the drum is opposed to the feed bed. The cam 41 rotatable with the print drum is so shaped that upon completeion of printing of the franking impression, the cradle is pivoted in the direction of arrow 21 to retract the impression roller to an inoperative retracted position indicated by broken line 22 in which it is spaced from the print drum and lies below the surface of the feed bed. When the impression roller is retracted the mail item 39 is no longer gripped by the print drum and impression roller and is free to be ejected from the franking machine.

The spring 17 on the cradle is required to move the cradle and the impression roller carried thereby from the inoperative retracted position to the operative position and also is required to provide adequate pressure to ensure that printing is effected on the mail item. The pressure exerted for printing needs to be fairly constant over a range of envelope thicknesses and this has necessitated the provision of relatively large constant force springs. The magnitude of this force creates adverse effects associated with high force, noise and wear.

It will be appreciated that the shaping of the cam 41 is such that it is ramped down from a high segment 42 which maintains the impression roller in the retracted inoperative position to a low segment 43 in which the impression roller is unrestrained and free to move towards its operative printing position. The force of engagement of the follower, due to the action of the spring 17, on the ramp 44 of the cam tends to drive the print drum forwardly in its printing revolution. This has the undesirable effect of tending to vary the speed of rotation of the print drum at about the time of the start of printing an impression.

In order to remove this force of the follower acting on the ramp of the cam, the pivoting motion of the cradle in the direction of arrow 20 is subjected to a damping action by a damper device 23. Accordingly as the cam rotates to release the cradle to pivot in the direction of arrow 20 and allow the impression roller to move towards its operative position, the damper prevents the cradle pivoting as rapidly as the cam would allow. The slowing of the pivotal movement of the cradle has the result of removing or at least substantially reducing the force of the cam follower 40 acting upon the ramp 44 of the cam thereby preventing any, or substantially any, rotational drive force being applied to the print drum from the cam follower.

Mail items may vary substantially in thickness from one to another. For example a label for attachment to a mail packet consists of a single thickness of paper sheet whereas a mail item consisting of an envelope containing a number of sheets of paper, which may be folded, will be of substantially greater thickness. Accordingly, in order that pressure for effective printing and feeding of a label is applied by the impression roller, it is necessary that the cam is shaped such as to allow the impression roller to move to an operative position in which it is spaced from the print drum by only the thickness of a single sheet label and is free to exert pressure under the action of the spring 17.

In order to more readily accommodate mail items of different thicknesses, the damper device 23 is constructed such as to be able to impart control to and arrest the pivotal movement of the cradle under the action of the spring 17. The construction and operation of the damper device will now be described with reference to FIG. 3(*a*). The damper device comprises a cylinder 24 in which a piston 25 is movable longitudinally. The piston 25 is mounted on a rod 26 which may be integral therewith and one end 27 of the rod extends through an end wall of the cylinder. The other end 35 of the rod 26 is guided in a sleeve bearing 34 to maintain the piston coaxial with the cylinder. The cylinder 24 of the damper device is secured to the base 10 of the franking machine and the end 27 of the rod is pivotally coupled to the cradle at a position 28 spaced from the axis 16 thereof. The piston and rod are electrically isolated from the cylinder and the cylinder is filled with a fluid material having electro-rheological properties. The fluid material used for filling the cylinder is a material which exhibits an electro-rheological property such that under normal conditions the material is fluid but when it is subjected to an electrical field of sufficient magnitude the orientation of the molecules of the material is changed and the material becomes solid. The fluidity of the material progressively decreases from a fluid state to a solid state as the applied electric field is increased. Materials exhibiting electro-rheological properties are well known and for example are referred to in the specifications of U.S. Pat. Nos. 4,444,298 and 3,144,921. Compositions of such materials are disclosed in the specification of U.S. Pat. No. 4,645,614. An electrical field is applied selectively to the fluid by means of electrical connections 29 and 30 to the rod and cylinder, respectively. Normally the fluid is not subjected to an electrical field but, immediately prior to the print drum rotating to a position in which the cam follower will engage the ramp of the cam, a field of sufficient magnitude is applied to cause the fluidity of the fluid material to decrease to an extent sufficient to slow the pivotal movement of the cradle under the action of the spring. With the leading edge of the mail item positioned between the print drum and the impression roller, the field is removed to permit unrestrained movement of the cradle under the action of the spring 17.

Means 31 may be provided to sense the thickness of a mail item prior to the mail item entering the nip between the print drum and the impression roller. The output from the sensing device 31 may be utilised to control pivotal movement of the cradle in the direction of arrow 20 by means of the electric field applied to the damper 23. As described hereinbefore an electric field of sufficient magnitude to slow the pivotal movement of the cradle is applied to the damper immediately prior to the cam follower engaging the ramp of the cam. When the cradle has moved to a pivotal position in which the impression roller is spaced from the print drum by a distance appropriate to the thickness of mail item being fed into the nip between the print drum and impression roller, the magnitude of the applied field is increased to a magnitude sufficient to cause the material in the cylinder to be in a substantially solid state and thereby arrest further pivotal movement of the cradle. When the mail item has entered the nip between the print drum and the impression roller the electric field is removed so that the impression roller is free to be urged, under the action of the spring 17, toward the print drum so as to apply printing pressure to the mail item.

Control means 45 is provided which responds to the rotational position of the print drum and the cam thereon, represented by signal from a sensor 46, to control the timing of the application of the electric field applied to the damper device 23 in relation to the rotation of the print drum. When the pivotal movement of the cradle is controlled in dependence upon the thickness of the mail item, the control means 45 responds additionally to the output of the mail item thickness sensing means 31 to control the application and timing of an applied electric field of higher magnitude to arrest movement of the cradle. For this latter arrangement, means 47 may be provided to sense the pivotal position of the cradle to enable arresting of the cradle at a selected position.

The damper may be controlled intelligently by utilising a microprocessor as the control means 45. The microprocessor is operated in a closed loop system and this enables the damper to be utilised to provide a controlled resistive force during the printing operation. Accordingly the force required to be provided by the spring can be substantially reduced to that required to move the cradle from the retracted position to the operative position. This reduction of spring force would be beneficial in reducing the wear and noise associated with high force springs.

Generally a field strength of approximately 3 KV/mm is required to ensure that the electro-rheological material is sufficiently solid to arrest movement of the piston in the cylinder. The electric potential for the applied field may be generated by means of a switch mode power supply device 48 operating at high frequency. With a spacing of the annular walls of the piston and cylinder of approximately 0.5 mm a potential of approximately 1.5 KV would be required. At ambient temperature, the current demand is approximately 1 $\mu$A rising to about 20 $\mu$A at high operating temperatures. The potential required to slow the pivotal movement of the cradle is less than 1.5 KV and the magnitude depends upon the degree of damping required.

Figure 3A:
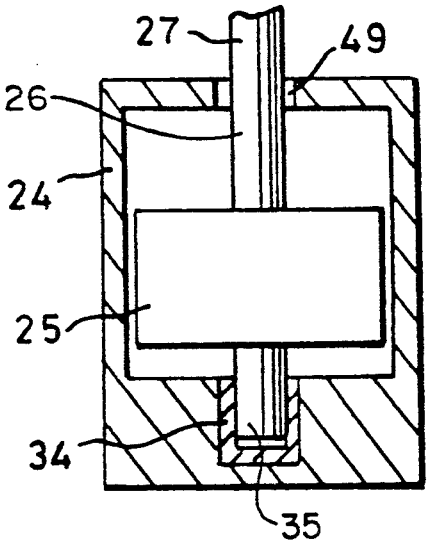
Figure 3B:
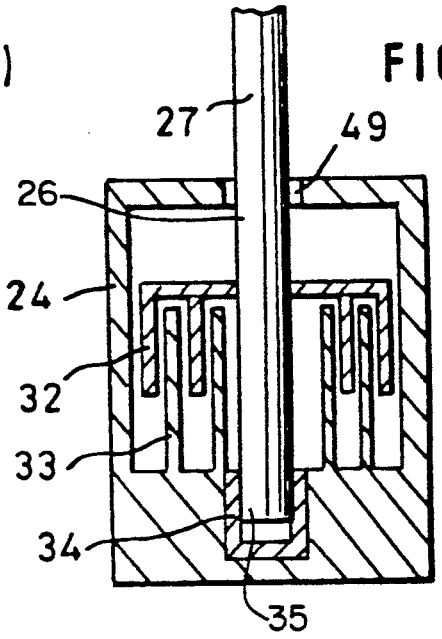

While a simple piston and cylinder may provide sufficient damping and braking forces to control movement of the cradle, in some instances a construction providing increased wall areas between which the fluid material is disposed may be required. One form of such construction is shown in FIG. 3(*b*). Instead of a simple cylindrical piston and cylinder, the piston is formed of a plurality of concentric spaced walls 32 and the cylinder is formed with a plurality of concentric spaced walls 33, the walls 32 of the piston being disposed to extend into the spaces between the walls 33 of the cylinder and to move in a direction along the axis thereof. The spacing of the walls 32 from the walls 33 is approximately 0.5 mm.

Instead of the piston of the damper being movable linearly relative to the cylinder thereof, the piston may be rotatable relative to the cylinder. With a construction of damper in which one component thereof is rotatable relative to the other component, the damper may be mounted with the axis thereof aligned with the pivotal axis 16 of the cradle with one component being secured to the base of the machine and the other component being secured directly to the cradle. If the axis 16 of the cradle is provided by a fixed rod secured to the base 10, the cylinder of the damper may be secured to or be an extension of the rod.

It will be appreciated that seals, indicated at 49, are provided between relatively movable components of the damper in order to prevent leakage of the fluid material from within the cylinder.

While a construction of mail item feeding and printing device for a franking machine has been described hereinbefore, it is to be understood that the invention is not limited to franking machines. The invention may be applied to other machines in which one roller is movable toward and away from another roller for the feeding of articles therebetween and particularly for such machines in which the articles to be fed may be of various thicknesses.

A clutch and brake mechanism for the printing drum of a franking machine is described and claimed in a co-pending patent application Ser. No. 07/626,522 entitled "Clutch and Braking Mechanism for franking machine" filed on the same data as this application. That application includes a description of a power supply suitable for generation and control of the electric field applied to a material exhibiting electro-rheological properties. The disclosure of that application is hereby incorporated in the present application. The disclosure of that application describes means to accommodate expansion and contraction of electro-rheological fluid and constructions of electrodes for a clutch and brake. Similar means and construction of electrodes may be utilised for the damper 23 of the present application.

The damper may be energised in such manner as to control movement of the cradle to an end stop position after completion of a printing cycle effected during rotation of the print drum.

I claim:

1. Apparatus for feeding articles comprising:

a base member;

a drum mounted for rotation about a first axis on said base member;

a roller rotatable about a second axis parallel to said first axis;

mounting means supporting said roller on said base member;

said roller being movable between an inoperative position spaced away from said drum and an operative position in which a nip is formed between said drum and said roller to feed an article therebetween;

a cam follower coupled to said mounting means;

cam means rotatable with said drum and engagable during rotation thereof by said cam follower;

drive means coupled to said drum and said cam means to rotate said drum in an article feeding direction of rotation;

spring means acting on said mounting means urging said roller from said inoperative position towards said operative position;

said cam means including a first cam segment co-acting with said cam follower to maintain said roller in said inoperative position spaced from said drum, a second cam segment co-acting with said cam follower to permit said roller to move under the action of said spring means to said operative position and a ramp portion extending from a trailing end of said first segment to a leading end of said second segment in said direction of rotation;

damper means including a first element coupled to said mounting means and moving with said mounting means and a second element mounted in fixed relation to said base member; a material between and in contact with said first and second elements; said material exhibiting electro-rheological properties and being fluid in the absence of an electric field and having a decreasing fluidity with increasing magnitude of electric field;

first and second spaced electrode means in electrical contact with said material;

control means responsive to rotational position of said cam means to apply an electric potential between said first and second electrode means to produce an electric field in said material during engagement of said cam follower with said trailing end of said first segment of said cam means to cause said material to resist movement of said first element relative to said second element, to maintain application of said electric potential while said ramp portion is adjacent said cam follower and thereafter to terminate application of said electric potential to permit said mounting means and said roller to move under the action of said spring means toward said operative position of said roller.

2. Article feeding apparatus as claimed in claim 1 wherein the cam means is mounted for rotation with the drum about the first axis.

3. Article feeding apparatus as claimed in claim 2 wherein the mounting means comprises a cradle pivotally mounted on a third axis relative to the base member, said third axis being parallel to said first and second axes.

4. Article feeding apparatus as claimed in claim 1 wherein the control means includes sensing means responsive to rotational position of said cam means.

5. Article feeding apparatus as claimed in claim 1 including first sensing means responsive to thickness of an article to be fed into the nip between the drum and the roller;

second sensing means responsive to position of the mounting means for the roller; and wherein the control means is operative, after rotation of the trailing end of the first segment of the cam means past the cam follower, in response to said first and second sensing means to control application of the electric potential to the electrode means to permit the roller to move under the action of the spring means from the inoperative position to an intermediate position dependent upon thickness of the article to be fed and is operative, after feeding of the article into said nip, to reduce said electric potential applied to the electrode means to permit further movement of the roller under action of said spring means to frictionally engage the article between the drum and the roller.

6. Article feeding apparatus as claimed in claim 1 wherein the drum carries printing elements to print a franking impression on the article during rotation of the drum in the article feeding direction.

7. Apparatus for franking mail items comprising:

a base member;

a print drum mounted for rotation about a first axis on said base member;

printing elements carried by said print drum;

an impression roller rotatable about a second axis parallel to said first axis;

mounting means supporting said impression roller on said base member; said impression roller being movable between an inoperative position spaced away from said drum and an operative printing position in which a nip is formed between said print drum and said impression roller to feed a mail item in printing engagement with said printing elements;

a cam follower coupled to said mounting means;

cam means rotatable with said print drum and engagable during rotation thereof by said cam follower;

drive means coupled to said print drum and said cam means to rotate said drum to feed said mail item between said print drum and said impression roller to effect printing on said mail item;

spring means acting on said mounting means to urge said impression roller from said inoperative position towards said operative printing position;

said cam means including a first cam segment co-acting with said cam follower to maintain said impression roller in said inoperative position spaced from said print drum, a second cam segment co-acting with said cam follower to permit said impression roller to move under the action of said spring means to said operative printing position and a ramp portion extending from a trailing end of said first segment to a leading end of said second segment in said direction of rotation;

damper means including a first element coupled to said mounting means and moving with said mounting means and a second element mounted in fixed relation to said base member; a material filling a space between said first and second elements; first and second spaced electrode means in electrical contact with said material;

said material being fluid and having a first viscosity and having a second viscosity, higher than said first viscosity, when subjected to an electric field; said second viscosity increasing with increase in magnitude of said electric field; control means responsive to rotational position of said cam means to apply an electric potential between said first and second electrode means to subject said material to said electric field during engagement of said cam follower with said trailing end of said first segment of said cam means to cause the viscosity of said fluid to increase from said first viscosity to said second viscosity sufficient to resist movement of said first element relative to said second element, to maintain application of said electric potential while said ramp portion is adjacent said cam follower and thereafter to terminate application of said electric potential to cause the viscosity of said material to decrease to said first viscosity and permit said mounting means and said impression roller to move under the action of said spring means toward said operative printing position of said impression roller.

8. Apparatus as claimed in claim 7 including first sensing means responsive to thickness of mail item to be fed into the nip between the print drum and the impression roller;

second sensing means responsive to position of the mounting means for the impression roller; and wherein the control means is operative, after rotation of the trailing end of the first segment of the cam means past the cam follower, in response to said first and second sensing means to control application of the electric potential to the electrode means to permit the impression roller to move under the action of the spring means from the inoperative position to an intermediate position dependent upon thickness of the mail item to be fed and is operative, after feeding of the mail item into said nip, to reduce said electric potential applied to the electrode means to permit further movement of the impression roller under action of said spring means to frictionally engage the mail item between said print drum and said impression roller.

* * * * *